US007260345B2

(12) United States Patent
Kamiya

(10) Patent No.: US 7,260,345 B2
(45) Date of Patent: Aug. 21, 2007

(54) IMAGE FORMING APPARATUS WITH A DEVELOPER CONSUMPTION CONTROL FEATURE

(75) Inventor: Yuji Kamiya, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 124 days.

(21) Appl. No.: 11/211,553

(22) Filed: Aug. 26, 2005

(65) Prior Publication Data

US 2006/0051115 A1 Mar. 9, 2006

(30) Foreign Application Priority Data

Sep. 7, 2004 (JP) ..... 2004-259958

(51) Int. Cl.
*G03G 15/08* (2006.01)
*G03G 15/06* (2006.01)
*G03G 15/09* (2006.01)

(52) U.S. Cl. ..... 399/257; 399/55; 399/269

(58) Field of Classification Search ..... 399/53, 399/55, 257, 269; 347/140
See application file for complete search history.

(56) References Cited

U.S. PATENT DOCUMENTS 3,927,641 A * 12/1975 Handa ..... 399/269
4,267,797 A * 5/1981 Huggins ..... 399/269
5,512,981 A * 4/1996 Hirsch ..... 399/257 X
5,911,098 A * 6/1999 Gyotoku et al. ..... 399/269 X
6,198,491 B1 3/2001 Honda ..... 347/129
6,330,405 B1 * 12/2001 Ishii et al. ..... 399/55
6,507,715 B2 * 1/2003 Okada ..... 399/55
6,766,121 B2 * 7/2004 Nonaka et al. ..... 399/257 X
7,085,506 B2 * 8/2006 Forbes et al. ..... 399/257 X

FOREIGN PATENT DOCUMENTS

| | | |
|---|---|---|
| JP | 62-45552 | 9/1987 |
| JP | 3-67285 | 3/1991 |
| JP | 3-251883 | 11/1991 |
| JP | 2878322 | 1/1999 |
| JP | 2978556 | 9/1999 |
| JP | 2000-172027 | 6/2000 |

* cited by examiner

*Primary Examiner*—Sandra L. Brase
(74) *Attorney, Agent, or Firm*—Fitzpatrick, Cella, Harper & Scinto

(57) ABSTRACT

An image forming apparatus having an image bearing member on which an electrostatic image is formed, a first developer carrying member carrying a developer thereon, and a second developer carrying member disposed downstream of the first developer carrying member with respect to the direction of movement of the image bearing member, and designed such that one and the same electrostatic image on the image bearing member is developed with the developer carried on these developer carrying members, has a developer consumption mode in which during the other time than ordinary image formation, the developer borne on the first and second developer carrying members is shifted to the image bearing member, and during this developer consumption mode, control is effected so that the amount of developer consumed from the second developer carrying member to the image bearing member may be greater than the amount of developer consumed from the first developer carrying member to the image bearing member.

5 Claims, 12 Drawing Sheets

FIG. 7

| BEFORE AND AFTER DURATION | DEVELOPING CHARACTERISTICS | CONVENTIONAL EXAMPLE 1 (WITHOUT CONSUMPTION MODE) | CONVENTIONAL EXAMPLE 2 (WITH CONSUMPTION MODE: SAME CONSUMPTION AMOUNT BETWEEN DOWNSTREAM AND UPSTREAM) | PRESENT EMBODIMENT |
|---|---|---|---|---|
| EARLY STAGE OF DURATION | AMOUNT OF EXTERNAL ADDITIVE | 1% | ← | ← |
| | MEAN PARTICLE DIAMETER | 8.0 μm | ← | ← |
| | IMAGE DENSITY | 1.45 | ← | ← |
| | WHITE BACKGROUND FOG | 1.0% | ← | ← |
| AFTER DURATION OF 300000 SHEETS | AMOUNT OF EXTERNAL ADDITIVE | 2.5% | 1.5% | 1% |
| | MEAN PARTICLE DIAMETER | 10.2 μm | 9.3 μm | 8.5 μm |
| | IMAGE DENSITY | 1.10 | 1.25 | 1.35 |
| | WHITE BACKGROUND FOG | 3.0% | 2.5% | 1.2% |

IMAGE FORMING APPARATUS WITH A DEVELOPER CONSUMPTION CONTROL FEATURE

BACKGROUND OF THE INVENTION

1. Field of the Invention

This invention relates to an image forming apparatus capable of being used in a printer, a copying machine or a facsimile apparatus of an electrophotographic type.

2. Related Background Art

In Japanese Patent Publication No. S62-45552, Japanese Patent No. 2878322 and Japanese Patent No. 2978556, there is disclosed a developing apparatus having a plurality of developing sleeves provided in opposed relationship with an electrophotographic photosensitive member. When a plurality of developing sleeves are used, development by the respective developing sleeves becomes possible at a plurality of developing positions and therefore, the amount of toner which contributes to the development of an electrostatic latent image on the photosensitive member can be increased. When the amount of toner contributes to development is great, it becomes easy to increase the density of a toner image.

Such a developing apparatus can secure a sufficient developing property even if the developing sleeves are not rotated at a high speed and therefore, is suited for a high-speed image forming apparatus. As the plurality of developing sleeves, two developing sleeves are popular by the reason that the complication of the construction of the developing apparatus is avoided. The two developing sleeves are disposed on the upstream side and downstream side, respectively, along the direction of rotation of the photosensitive member.

On the other hand, in Japanese Patent Application Laid-Open No. 2000-172027, there is proposed a consumption mode in which a toner near a developing sleeve is discharged to an electrophotographic photosensitive member except during image formation (during non-image formation). As the purposes of executing the consumption mode, mention may be made of realizing a longer life of the developing apparatus within a long-period range, and improving a cleaning property by the supply of the toner to other portions, such as a transferring portion and a cleaner portion in the image forming apparatus, than the developing apparatus.

Now, in the developing apparatus having two developing sleeves opposed to the photosensitive member, the consumption rate of a developer per sheet of image individually differs depending on the developing condition of the developing sleeve on the upstream side and the developing condition of the developing sleeve on the downstream side. Also, the consumption rate of the developer per sheet of image, even when the developing conditions of the developing sleeves on the upstream side and the downstream side are the same, may differ depending on the coverage rate of an image outputted. In the case of the output of a solid image, however, the consumption rate of the developer becomes a substantially constant rate.

Generally, the consumption rate of the developer tends to be higher on the upstream side than on the downstream side. This is because although on the upstream side, the toner does not adhere to an electrostatic latent image carried to a developing position, the toner has already adhered to the electrostatic latent image when carried to a developing position on the downstream side on the upstream side and therefore, the intensity of an electric field for making the toner adhere is correspondingly low. Also, another reason is that the time required for the electrostatic latent image to arrive at the developing position is longer on the downstream side than on the upstream side and therefore, a minute reduction in the potential of the latent image with the lapse of time which is called the dark attenuation of the photosensitive member becomes great. If the toner is made to fly on the upstream side and a small amount of toner is added on the downstream side and at the same time, the action of putting the toner on the electrostatic latent image on the photosensitive member in order is given, the consumption rate on the upstream side tends to become greater than that on the downstream side, when viewed also from the characteristic that an image of a high quality is obtained.

However, when the consumption rate of the developer is greater by the developing sleeve on the upstream side than by the developing sleeve on the downstream side, the following problem arises.

When images are confirmed within a long-period range, there occurs the inconvenience that the output density is lowered or the fog phenomenon increases. The reason for this is that on the downstream side, the photosensitive member to which the toner has adhered is rotated from the upstream side and therefore, including the fact that part of the toner having adhered on the upstream side is stripped off, the toner consumption rate on the downstream side is lower than the toner consumption rate on the upstream side. Therefore, the toner consumption rate near the developing sleeve on the downstream side is small as compared with the upstream side, and only the appropriately charged toner becomes liable to be consumed, and the relatively inappropriate toner comes to be gradually accumulated near the developing sleeve on the downstream side. Here, the relatively inappropriate toner (faulty toner) means a toner of a composition ratio which is not in the initial toner, and for example, in the case of a one-component magnetic toner, it is the phenomenon that the ratio of an abrasive material or a charge controlling agent as an extraneous additive becomes great or small as compared with the initial toner, or the phenomenon that the mean particle diameter of the toner becomes great or bipolar as compared with the initial stage. Also, when the toner consumption amount decreases, the amount of toner stagnating near the developing sleeve becomes great, and this sometimes leads to a case where the toner receives the heat in the interior of the image forming apparatus or stress such as the frictional contact by the rotation of the developing sleeve, and becomes different in developing characteristic from the initial toner. As the overall result of these, there arises the problem in a long-period range that the output density is lowered or the fog phenomenon increases.

SUMMARY OF THE INVENTION

It is the object of the present invention to provide an image forming apparatus which can prevent the deterioration of an image attributable to the use of a plurality of developer carrying members.

An image forming apparatus for achieving the above object has:

an image bearing member on which an electrostatic image is formed;

developing means having a first developer carrying member carrying a developer thereon, and a second developer carrying member disposed downstream of the first developer carrying member with respect to the direction of movement of the image bearing member, and for developing one and the same electrostatic image on the image bearing member with the developer carried on these developer carrying members; and controlling means for executing a developer consumption mode in which the developer carried on the first and second developer carrying members is shifted to the image bearing member during the other time than ordinary image formation;

wherein the controlling means controls so that during the developer consumption mode, the amount of developer consumed from the second developer carrying member to the image bearing member may be greater than the amount of developer consumed from the first developer carrying member to the image bearing member.

BRIEF DESCRIPTION OF THE DRAWINGS

FIG. 7 illustrates the developing characteristics of Conventional Example 1, Conventional Example 2 and the present embodiment at the early stage of duration and after the duration of 300,000 sheets.

DESCRIPTION OF THE PREFERRED EMBODIMENTS

Figure 1:
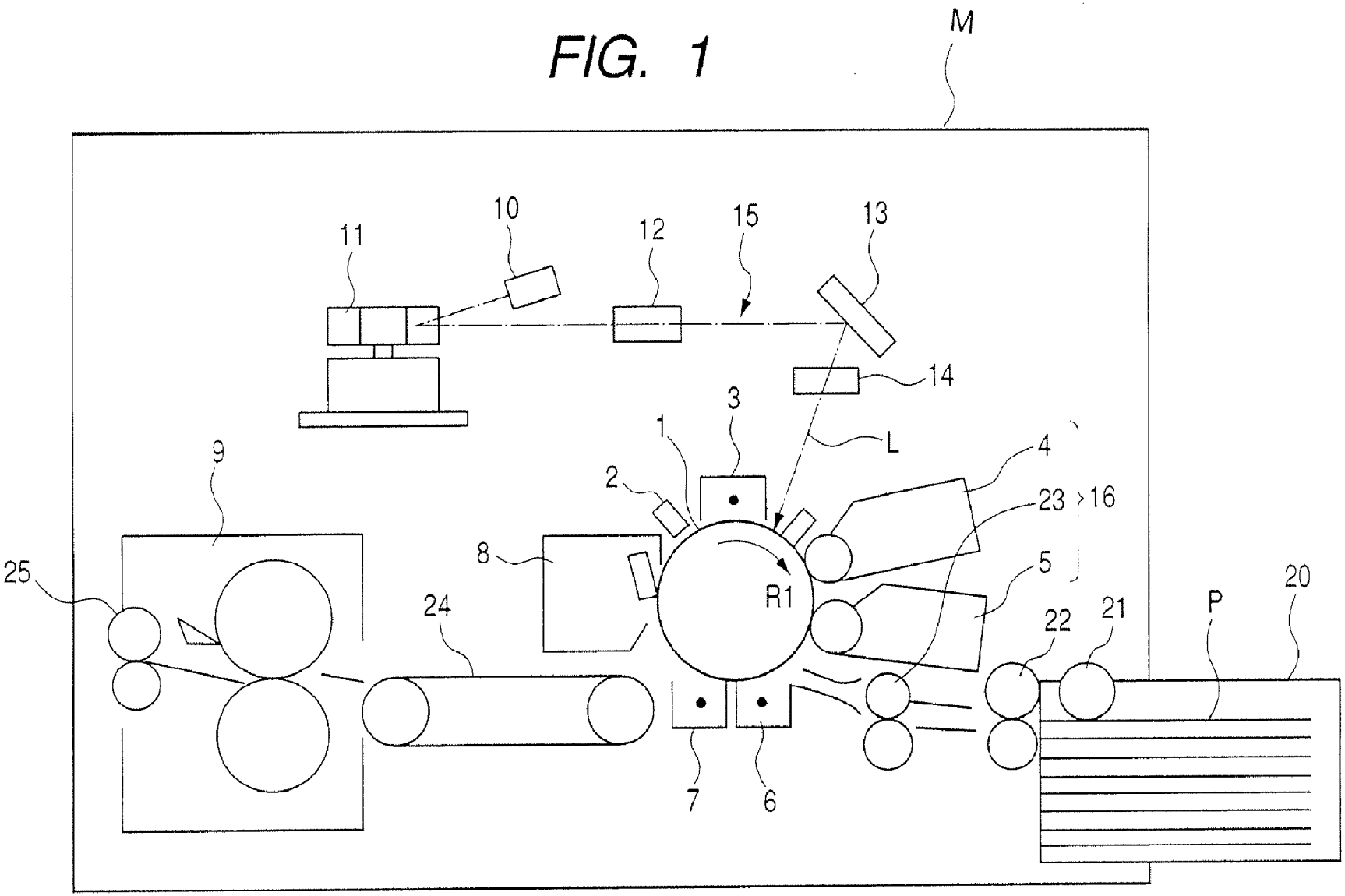
FIG. 1 is a longitudinal cross-sectional view schematically showing the construction of an image forming apparatus to which the present invention can be applied.

Some embodiments of the present invention will hereinafter be described with reference to the drawings. Throughout the drawings, like reference characters designate members similar in construction or function, and the duplicate description of these will be suitably omitted.

Embodiment 1

FIG. 1 is a longitudinal cross-sectional view schematically showing the construction of a developing apparatus to which the present invention can be applied, and an image forming apparatus provided with the same. The image forming apparatus shown in FIG. 1 is a printer (hereinafter referred to as the "image forming apparatus") of an electrophotographic type.

This image forming apparatus is provided with a drum-shaped electrophotographic photosensitive member (hereinafter referred to as the "photosensitive drum") 1 as an image bearing member. The photosensitive drum 1 is constituted, for example, by a photosensitive member of a-Si (amorphous silicon) having a diameter of 108 mm. The photosensitive drum 1 is rotatably supported by an image forming apparatus main body M and is rotatively driven at a predetermined process speed (peripheral speed), e.g. 450 mm/sec. in the direction of arrow R1 by driving means (not shown). Thereby, black-and-white images can be formed 85 sheets of recording material of A4 size per minute. The photosensitive drum 1 constituted by the photosensitive member of a-Si as described above has the features that as compared with a photosensitive drum constituted by an organic photoconductive member (OPC), the specific dielectric constant is as great as the order of 10, that the charging potential is relatively low, and that although as compared with the OPC, the latent image potential cannot be sufficiently secured, the durability is high and the life reaches 3,000,000 sheets or more and this is suited for a high-speed (high-throughput) image forming apparatus.

The photosensitive drum 1 has the charges of its surface eliminated by a charge eliminating device 2 constituted by an LED array, and thereafter is uniformly charged to a predetermined polarity and potential (e.g. +420V) by a charger 3. This potential is dark portion potential VD.

An electrostatic latent image is formed on the surface of the photosensitive drum 1 after charged, by an exposing apparatus 15. The exposing apparatus 15 has a semiconductor laser 10 emitting a laser beam L based on image information. The am L emitted from the semiconductor laser 10 is applied to the surface of the photosensitive drum 1 after charged, via a polygon mirror 11, an fθ lens 12, a return mirror 13 and dust-proof glass 14 or the like. The wavelength of the laser beam L is 680 nm and the resolution thereof is 600 dpi. The spot diameter of the laser beam L on the photosensitive drum 1 is a size somewhat larger than a pixel of 600 dpi=42.3 mm. The surface potential of the photosensitive drum 1 after exposed, i.e., the light portion potential VL is e.g. of the order of ±50V. Thus, by the application of the laser beam L by the exposing apparatus 15, an electrostatic latent image is formed on the surface of the photosensitive drum 1 after exposed.

This electrostatic latent image is developed by a developing apparatus 16 having an upstream developing device 4 and a downstream developing device 5. The upstream developing device 4 is disposed on an upstream side with respect to the direction of rotation of the photosensitive drum 1 (the direction of arrow R1), and the downstream developing device 5 is disposed downstream of the upstream developing device 4 with respect also to the direction of rotation of the photosensitive drum 1. Toners of the same components and characteristics are contained in the upstream developing device 4 and the downstream developing device 5. In the present embodiment, a one-component magnetic toner is used as a developer. Also, the toner is a positive toner having a weight mean particle diameter of 8.0 μm. The toner is caused to adhere to the electrostatic latent image on the photosensitive drum 1 by the developing apparatus 16, whereby the electrostatic latent image is developed as a toner image. The developing apparatus 16 will be described later in detail.

The toner image thus formed on the surface of the photosensitive drum 1 is transferred onto a recording material P (e.g. paper or transparent film) by a transferring charger 6. This recording material P is supplied from a sheet supplying cassette 20 to between the photosensitive drum 1 and the transferring charger 6 through the intermediary of a sheet feeding roller 21, conveying rollers 22, registration rollers 23, etc. in such a manner as to be timed with the toner image on the photosensitive drum 1. The toner image on the photosensitive drum 1 is transferred onto the supplied recording material P by the transferring charger 6.

After the transfer of the toner image, the photosensitive drum 1 has any toner residual on its surface (residual toner) removed by a cleaning apparatus 8, and has its charges eliminated by the above-mentioned charge eliminating device 2, and thereafter is used for the next image formation (image outputting).

On the other hand, the recording material P after the transfer of the toner image thereto is separated from the surface of the photosensitive drum 1 by a separating charger 7, and is conveyed to a fixing apparatus 9 by a conveying belt 24. The recording material P is heated and pressurized by the fixing apparatus 9, whereby the toner image is fixed on the surface of the recording material P. After the fixing of the toner image, the recording material P is discharged to the outside of the image forming apparatus main body M by sheet discharging rollers 25. Thereby, the formation of the toner image on a sheet of recording material. P is completed.

Figure 2:
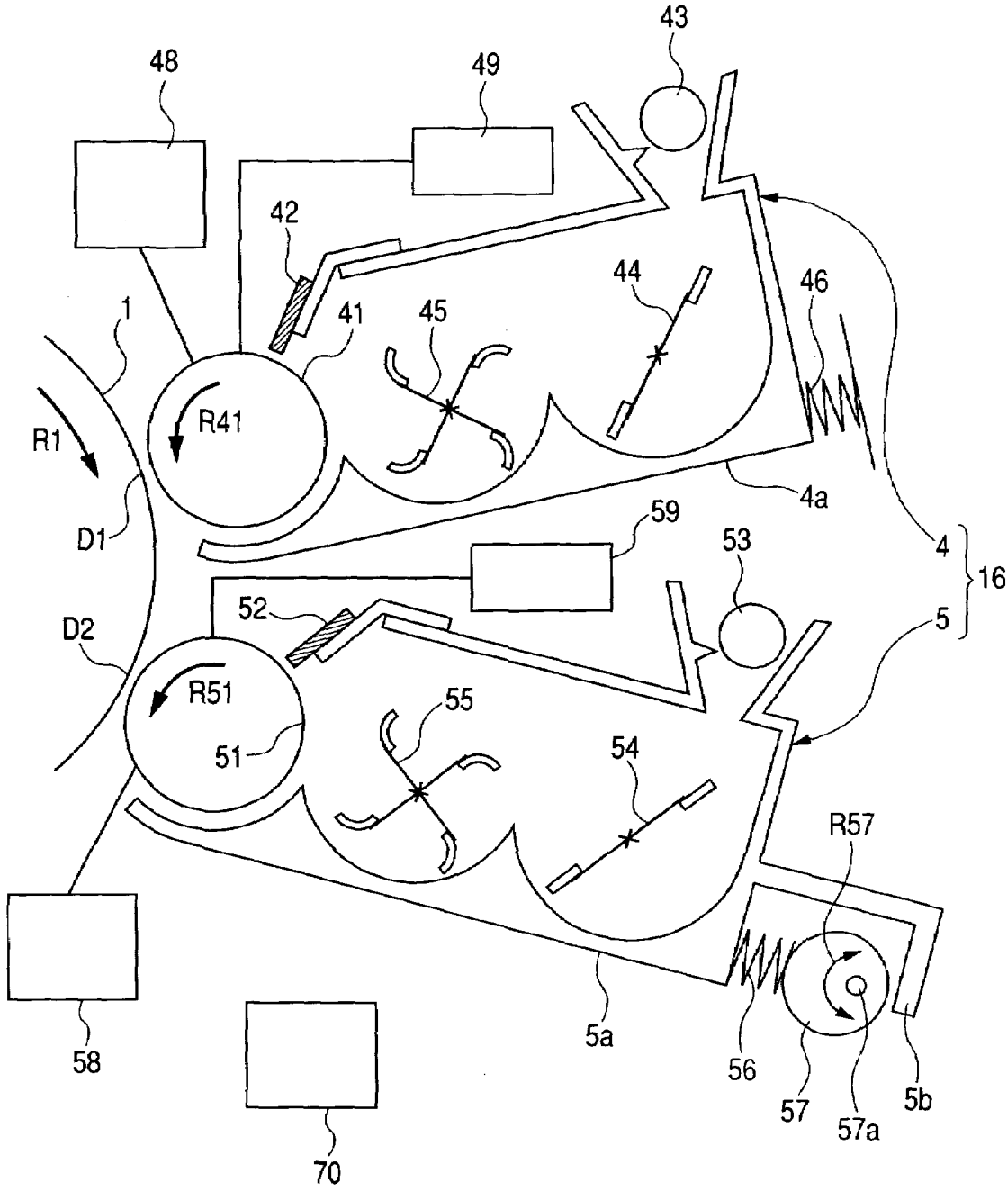
FIG. 2 is an enlarged longitudinal cross-sectional view of a developing apparatus having an upstream developing device and a downstream developing device.

FIG. 2 is an enlarged longitudinal cross-sectional view of the developing apparatus 16 in a direction along the direction of rotation of the photosensitive drum 1 (the direction of arrow R1). The upstream developing device 4 is disposed on the upstream side with respect to the direction of rotation of the photosensitive drum 1, and the downstream developing device 5 is disposed on the downstream side. The upstream developing device 4 and the downstream developing device 5 are substantially the same in basic construction. The upstream developing device 4 and the downstream developing device 5 have developer containers 4*a* and 5*a*, developing sleeves 41 and 51, regulating blades 42 and 52, magnet rollers 43 and 53, first agitating members 44 and 54, second agitating members 45 and 55, pressure springs (compression springs) 46 and 56, driving motors 48 and 58, and developing bias applying voltage sources (high voltage sources) 49 and 59, respectively. Controlling means 70 effects the control of the image forming apparatus including these high voltage sources, etc. Further, the downstream developing device 5 has an eccentric cam 57. The upstream developing device 4 does not have such an eccentric cam.

The developing sleeves 41 and 51 on the upstream side and the downstream side, respectively, are disposed in the opening portions of the developer containers 4*a* and 5*a*, and are opposed to the surface of the photosensitive drum 1. The developing sleeves 41 and 51 have spacer rings (not shown) mounted on the longitudinal (axial) opposite end portions thereof. The developing sleeves 41 and 51 are pressurized by the pressure springs 46 and 56 with the developer containers 4*a* and 5*a* interposed therebetween, to thereby bring the spacer rings into contact with the non-image forming portions at the longitudinal opposite end portions of the surface of the photosensitive drum 1. Thereby, a predetermined gap (e.g. 200 μm) is formed between the developing sleeves 41, 51 and the surface of the photosensitive drum 1. With regard to the developing sleeve 51 on the downstream side, as will be described later, the gap between it and the surface of the photosensitive drum 1 is adapted to be changed in a direction for increase by the rotation of the eccentric cam 57, with the case where the above-mentioned spacer rings are brought into contact as the minimum. The developing sleeves 41 and 51 are rotatively driven in the direction of arrow R41 and the direction of arrow R51, respectively, by the driving motors 48 and 58. These directions of rotation are opposite to the direction of rotation of the photosensitive drum 1, and accordingly, the photosensitive drum 1 and the developing sleeves 41 and 51 are designed such that their respective surfaces are moved in the same direction at developing positions D1 and D2 whereat their surfaces face each other. Design is made such that a developing bias comprising an inherent DC component and an inherent AC component superimposed one upon the other is applied to the developing sleeves 41 and 51 by the developing bias applying voltage sources 49 and 59.

The toners in the developer containers 4*a* and 5*a* are carried on (coat) the surfaces of the developing sleeves 41 and 51, and have their layer thicknesses regulated by the regulating blades 42 and 52, and thereafter are carried to the developing positions D1 and D2. In the present embodiment, the gaps between the developing sleeves 41, 51 and the regulating blades 42, 52 are set to 200 μm. The toners in the developer containers 4*a* and 5*a* are gradually consumed as the number of image-formed sheets are increased. Toners are supplied from a hopper (not shown) into the developer containers 4*a* and 5*a* by the rotation of the magnet rollers 43 and 53. The supplied toners are carried toward the developing sleeves 41 and 51 by the first agitating members 44, 54 and the second agitating members 45, 55.

As described above, the upstream developing device 4 has its spacer ring brought into contact with the surface of the photosensitive drum 1 by the developing sleeve 41 on the upstream side being biased by the pressure spring 46 with the developer container 4*a* interposed therebetween. Thereby, a predetermined gap (200 μm) is secured between the surface of the photosensitive drum 1 and the surface of the developing sleeve 41 at the developing position D1.

In contrast, in the downstream developing device 5, the gap between the surface of the photosensitive drum 1 and the surface of the developing sleeve 51 is variable. In the downstream developing device 5, a hook-shaped engagement portion 5*b* is provided on the back side (the side far from the photosensitive drum 1) of the developer container 5*a*. When the eccentric cam 57 is disposed at a position shown in FIG. 2, the engagement of the eccentric cam 57 with the engagement portion 5*b* is released. In this case, the developing sleeve 51 is biased by the pressure spring 56 with the developer container 5*a* interposed therebetween to thereby bring the spacer ring into contact with the surface of the photosensitive drum 1. Thereby, a predetermined gap (200 μm) is secured between the surface of the photosensitive drum 1 and the surface of the developing sleeve 51. On the other hand, when the eccentric cam 57 is rotated about a shaft 57*a* as shown by bidirection arrow R57, the eccentric cam 57 comes into contact with the engagement portion 5*b* to thereby move the developer container 5*a* away from the photosensitive drum 1 against the biasing force of the pressure spring 56. When the eccentric cam 57 is rotated by nearly 180 degrees from the position shown in FIG. 2, the developer container 5*a* is moved most backward, and the gap between the surface of the photosensitive drum 1 and the surface of the developing sleeve 51 at the developing position D2 becomes the order of maximum 4 mm. Like this, the gap between the developing sleeve 51 on the downstream side and the photosensitive drum 1 is adapted to vary within a range of 200 μm to 4 mm. Design is made such that when the developing sleeve 51 is spaced apart, that is, when the gap becomes 4 mm, the development by the flight of the toner from the downstream developing device 5 is not effected and the stripping action does not work upon the toner having adhered from the upstream developing device 4 to the photosensitive drum 1.

Figure 3:
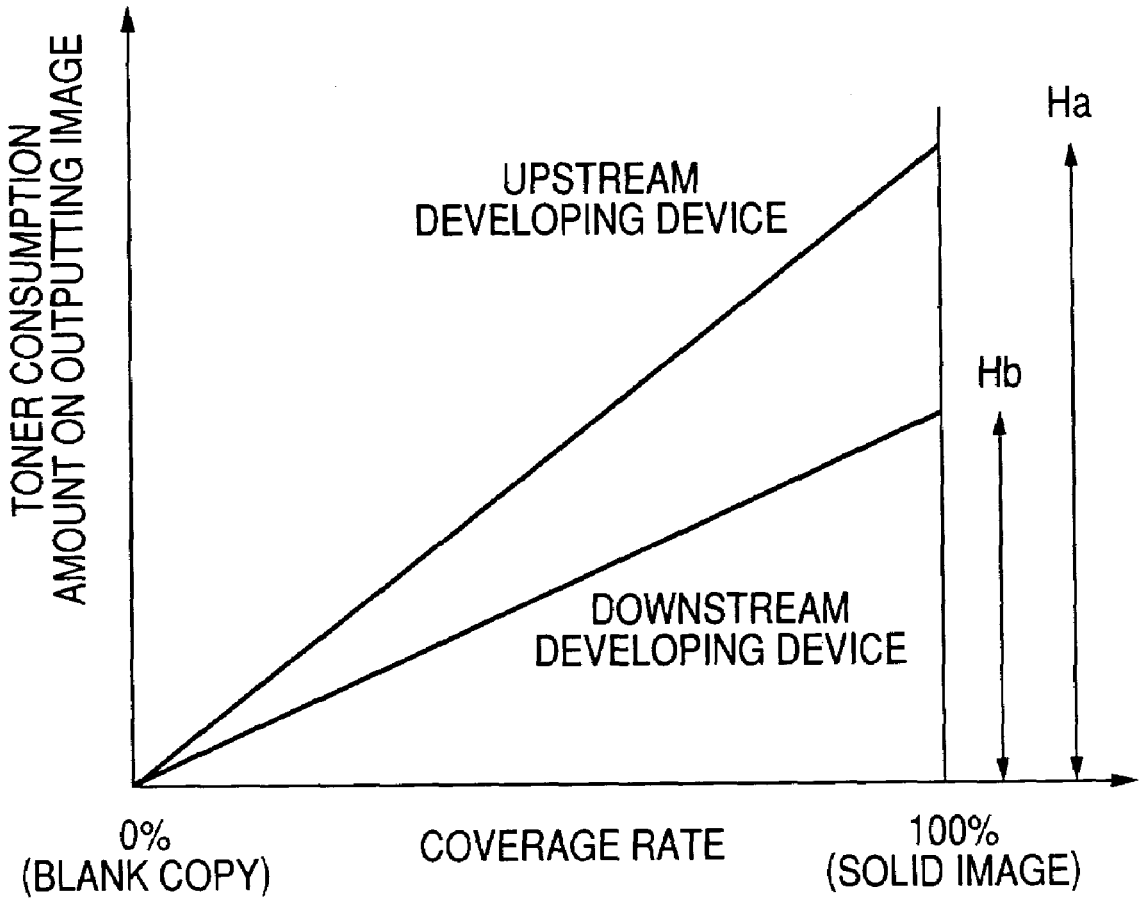
FIG. 3 shows the relation between the coverage rates and the toner consumption amounts of the upstream developing device and the downstream developing device during image outputting.

FIG. 3 illustrates the toner consumption amount (toner supply amount) with regard to the upstream developing device 4 and the downstream developing device 5 when the coverage rate of image has been varied. In FIG. 3, the axis of abscissas indicates a coverage rate 0% (blank copy) to a coverage rate 100% (solid image), and the axis of ordinates indicates the toner consumption amount on outputting image. The developing conditions of the upstream developing device 4 and the downstream developing device 5 are the same.

In the blank copy state of the coverage rate 0%, neither of the upstream developing device 4 and the downstream developing device 5 consumes the toner and therefore the curve passes through the 0 point. In contrast, as the solid image state of the coverage rate 100% is approached, the curve indicates a rightwardly upward characteristic. In the construction of the present embodiment, the toner consumption amount in the solid image state is such that the toner consumption amount Ha of the upstream developing device 4 exceeds the toner consumption amount Hb of the downstream developing device 5. This is because with the rotation of the photosensitive drum 1 in the direction of arrow R1, the electrostatic latent image on the photosensitive drum 1 first arrives at the developing position D1 on the upstream side, and then arrives at the developing position D2 on the downstream side. Here, when the electrostatic latent image has arrived at the developing position D1 on the upstream side, the toner has not yet adhered onto this electrostatic latent image. In contrast, when the electrostatic latent image has arrived at the developing position D2 on the downstream side, the toner has already adhered onto this electrostatic latent image by the upstream developing device 4. Therefore, a difference occurs to the intensity of electric field. That is, the intensity of electric field at the developing position D1 on the upstream side exceeds the intensity of electric field at the developing position D2 on the downstream side. Thus, the toner consumption amount on the upstream side exceeds that on the downstream side. Such a tendency is an ordinary one.

Also, this is because the time until the electrostatic latent image on the photosensitive drum 1 formed by exposure arrives at the developing position D2 on the downstream side is longer than the time until the electrostatic latent image on the photosensitive drum 1 arrives at the developing position D1 on the upstream side, and on the downstream side, the minute reduction in the latent image potential with the lapse of time called the dark attenuation of the photosensitive drum 1 also becomes great.

Further, considering from the characteristic that an image of a higher quality is obtained if development is effected with the toner made to fly in the upstream developing device 4, and in the downstream developing device 5, a small amount of toner is added and at the same time, the action of putting the toner on the electrostatic latent image on the photosensitive drum 1 in order is given, the toner consumption amount of the upstream developing device 4 tends to become greater than the toner consumption amount of the downstream developing device 5.

Figure 4:
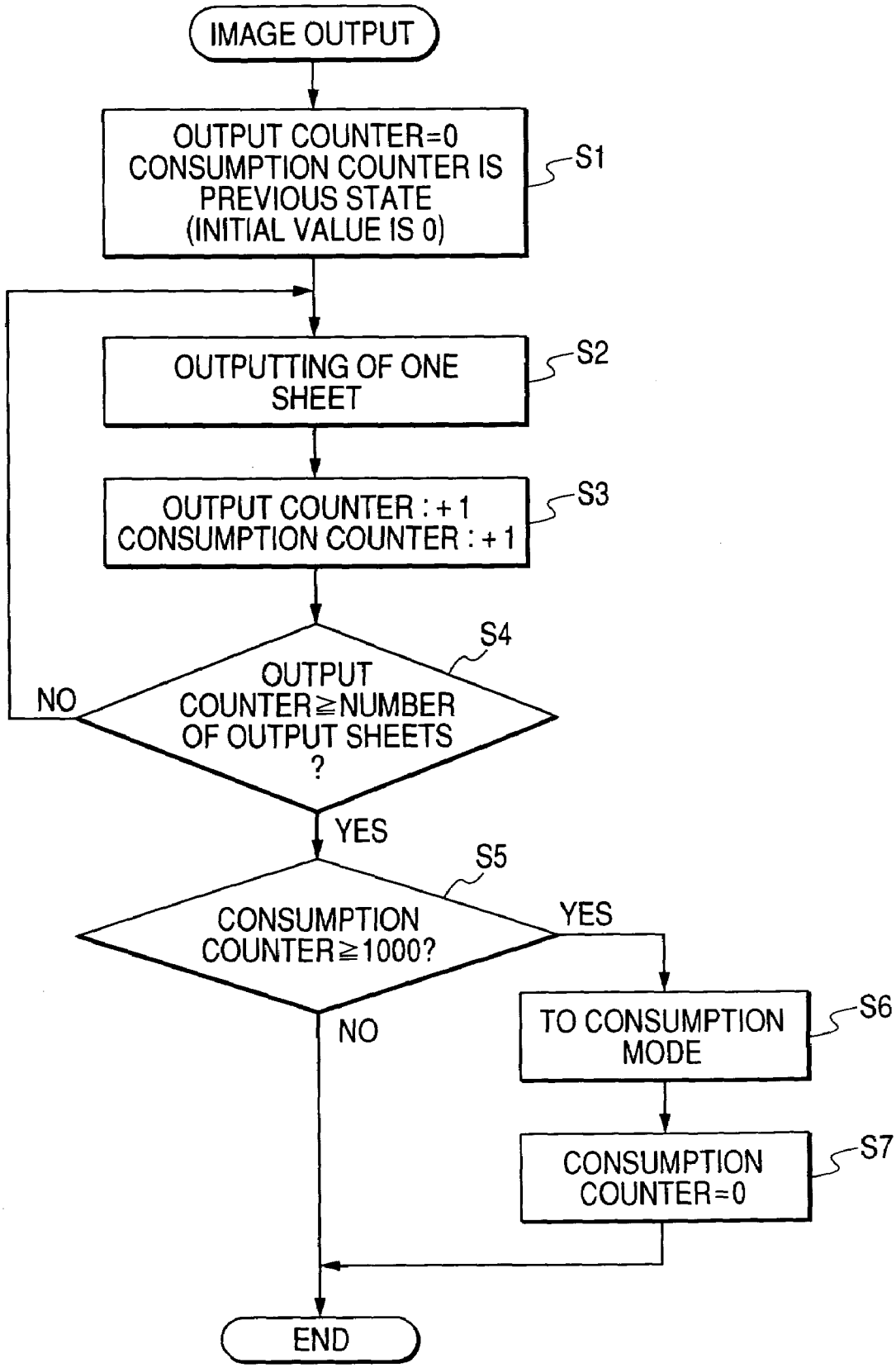
FIG. 4 is a flow chart for image outputting and illustrating the process to the execution of the consumption mode of the present invention.

FIG. 4 is a flow chart for image outputting, and illustrating a process to the execution of a consumption mode in the present embodiment.

First, an output counter for outputting images up to a predetermined number of output sheets designated by a user is set to 0. A consumption counter is provided as a counter discrete from this output counter, and the value of this counter is not changed, but the previous value is intactly used (S1). However, during the initial installation of the image forming apparatus, 0 has entered as an initial value. Next, the aforedescribed image forming process is carried out to thereby effect a sheet of image output (S2). Thereafter, both of the output counter and the consumption counter are incremented (+1)(S3). Whether the output counter has reached the predetermined number of output sheets designated by the user is confirmed (S4), and if has not reached (No at S4), return is made to the step S2. On the other hand, if it has reached the predetermined number of output sheets (Yes at S4), whether the consumption counter has reached a predetermined number of output sheets (in the example shown in FIG. 4, 1,000 sheets) is confirmed (S5). If the consumption counter has not reached 1,000 sheets (No at S5), the flow is terminated. On the other hand, if the consumption counter has reached 1,000 sheets (Yes at S5), the consumption mode of the present embodiment is executed after image outputting (S6). After the execution, the consumption counter is reset to 0 (S7). In this manner, the image outputting and the consumption mode are controlled by the respective counters. According to this flow chart, discretely from the output counter for image outputting, the consumption mode is executed for each 1,000 sheets. The number of sheets counted by the consumption counter is not restricted to 1,000 sheets, but another suitable number of sheets may be set. Also, as the timing for executing the consumption mode, this mode may be executed before the first image outputting after the consumption counter has reached 1,000 sheets is effected. The consumption mode may be executed not only after the image outputting, but also before the image outputting or between a preceding recording material and the succeeding recording material (between the sheets). However, taking the usability by the user into account, the first closing of the power supply switch of the image forming apparatus after the image outputting or after the consumption counter has reached the predetermined number of output sheets is preferable as the aforementioned timing. The control of these is effected by the controlling means 70.

Figure 5:
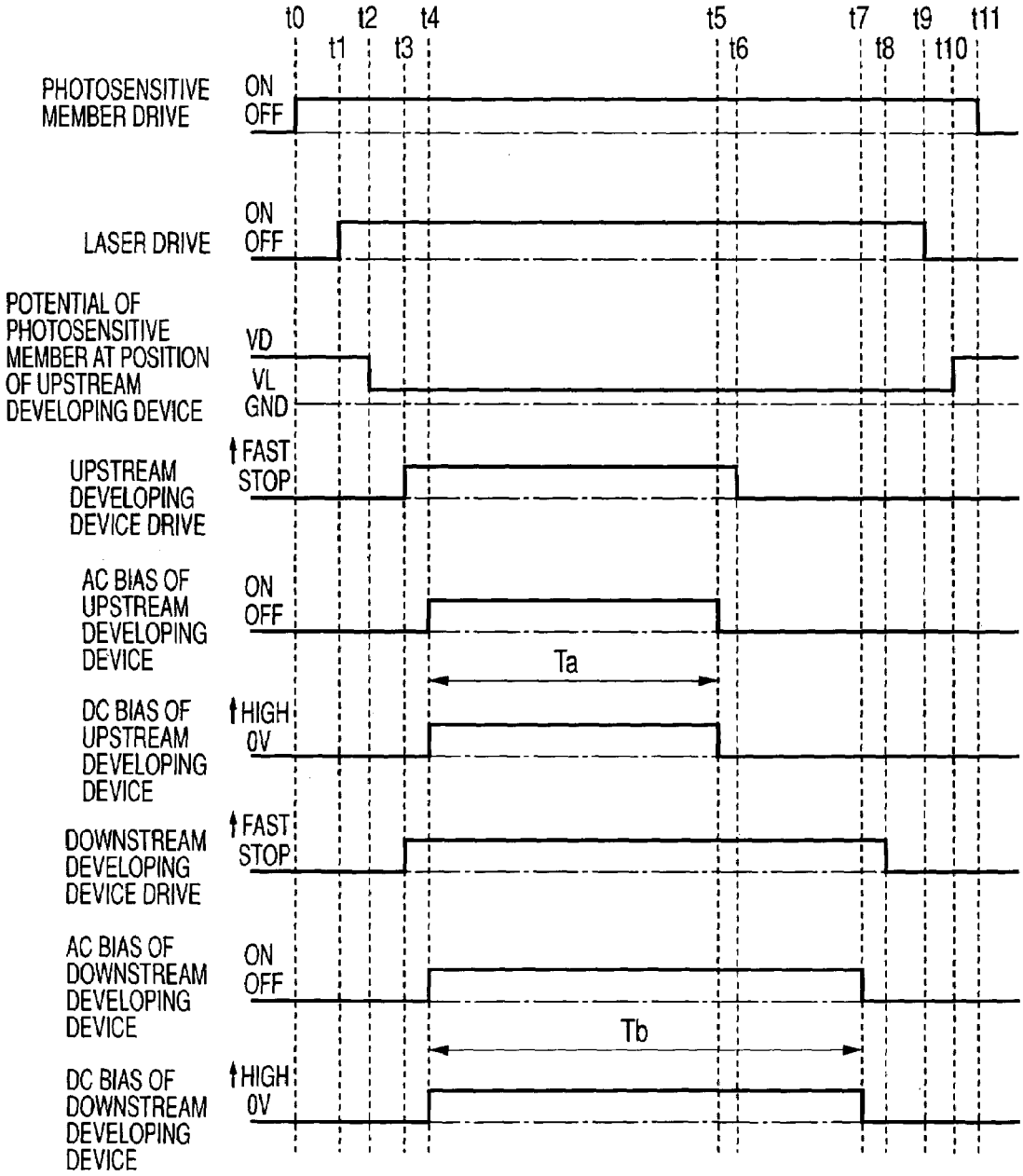
FIG. 5 is a time chart in the consumption mode of Embodiment 1.

FIG. 5 is a time chart illustrating the above-described flow of the consumption mode.

First, the photosensitive drum 1 (hereinafter suitably referred to as the "photosensitive member 1") is driven (rotated) (time t0, hereinafter simply referred to as "t0"). However, in a case where as shown in FIG. 4, the consumption mode is executed after the achievement of the image outputting, and is executed during the post-rotation of the photosensitive member 1, the photosensitive member 1 may be driven from the first. At the timing to whereat the photosensitive member 1 is driven, the driving of the laser is OFF, the potential of the photosensitive member at the position of the upstream developing device 4 is dark portion potential (VD), the driving of the upstream developing device 4 is stopped, the AC bias of the upstream developing device 4 is OFF, the DC bias of the upstream developing device 4 is 0V, the driving of the downstream developing device 5 is stopped, the AC bias of the downstream developing device 5 is OFF, and the DC bias of the downstream developing device 5 is 0V.

Next, the laser is turned on with a predetermined quantity of light (t1), whereupon in accordance with the rotation of the photosensitive member 1, a predetermined time after, the potential of the photosensitive member at the position of the upstream developing device 4 becomes light portion potential VL (t2), and toner development becomes possible. Then, the driving of the upstream developing device 4 and the downstream developing device 5 is effected (t3), and a developing bias is applied to each of the upstream developing device 4 and the downstream developing device 5 (t4). Here, the developing bias is the AC bias and DC bias of the upstream developing device 4, and is the AC bias and DC bias of the downstream developing device 5. When the AC bias and the DC bias are applied, the development of the electrostatic latent image on the surface of the photosensitive member is started. The electrostatic latent image in the light portion of light portion potential VL thereof is developed into a solid image.

Thereafter, after the lapse of a predetermined time Ta, the AC bias and DC bias of the upstream developing device 4 are turned off (t5), whereupon the development by the upstream developing device 4 is stopped. Also, there is necessity of unnecessarily rotating the upstream developing device 4 and therefore, the driving of the upstream developing device 4 is stopped (t6). After the lapse of a predetermined time Tb (>Ta) from t4, the AC bias and DC bias of the downstream developing device 5 are turned off (t7), whereupon the development by the downstream developing device 5 is stopped. Thereafter, the driving of the downstream developing device 5 is stopped (t8), the laser is turned off (t9), the potential of the photosensitive member is rendered into the state of the dark portion potential VD (t10), and the photosensitive member 1 is stopped. Thereby, the consumption mode is terminated.

Figure 6:
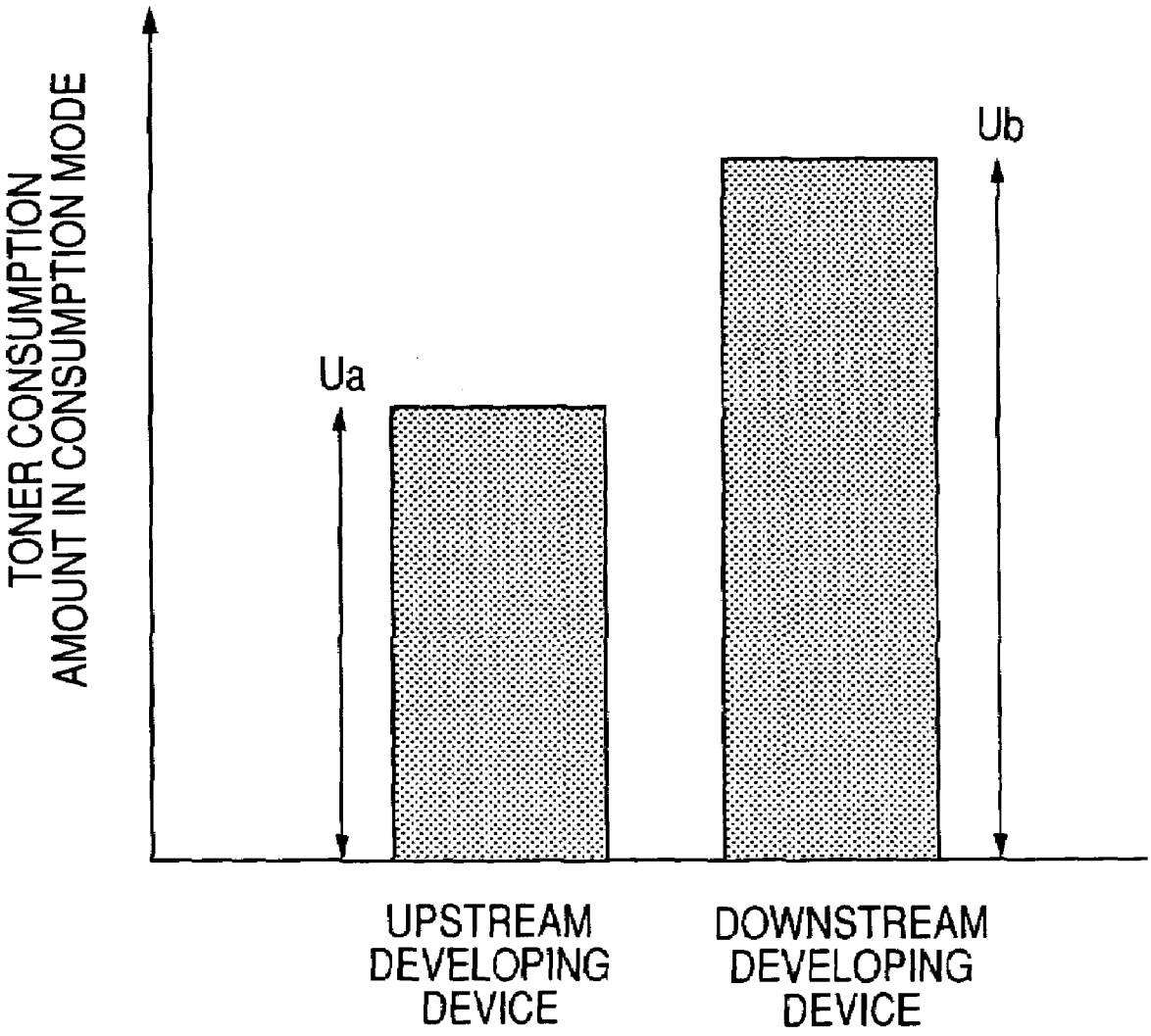
FIG. 6 shows the toner consumption amount in the consumption mode as it is divided into the upstream developing device and the downstream developing device.

FIG. 6 shows the toner consumption amount (toner discharge amount) in the consumption mode illustrated in FIG. 5 with respect separately to the upstream developing device 4 and the downstream developing device 5. In the present invention, as shown in the timing chart of the consumption mode, the toner consumption amount Ub of the downstream developing device 5 is greater than the toner consumption amount Ua of the upstream developing device 4, and Ua=2 g and Ub=3 g. This is because as shown in FIG. 3, it is the gist of the present invention to reverse the relation of the toner consumption amount Ua of the upstream developing device 4 and the toner consumption amount Ub of the downstream developing device 5 in the consumption mode to the toner consumption amount Ha of the upstream developing device 4 and the toner consumption amount of the downstream developing device 5 during image outputting, as shown in FIG. 6. Ua and Ub need not be fixed, but the absolute values of Ua and Ub may be changed while the mean coverage rate during image outputting is measured by a video counter or the like, and if such a degree of relation that Ha:Hb=Ub:Ua substantially holds good is maintained, it will be most effective.

FIG. 7 shows the comparison of the present embodiment with Conventional Example 1 and Conventional Example 2 regarding the developing characteristics before and after duration. As the developing characteristics, there are shown the amount of extraneous additive and the mean particle diameter which govern the characteristic of the toner, and image density and white background fog which are an output characteristic. In Conventional Example 1, the consumption mode is not provided, and in Conventional Example 2, a consumption mode at the same time interval as that in the present embodiment is provided, but the toner consumption amount is set so as to be the same in the upstream developing device 4 and the downstream developing device 5. Also, the present embodiment has the consumption mode as described above. At the early stage of duration, Conventional Example 1, Conventional Example 2 and the present embodiment are all the same in the developing characteristic. That is, at the early stage of duration, in all of the conventional examples and the present embodiment, the amount of extraneous additive is 1%, the mean particle diameter is 8.0 μm, the image density is 1.45, and the white background fog (the fog of the white background) is 1.0%.

In Conventional Example 1 having no consumption mode, after the duration of 300,000 sheets, the amount of extraneous additive is increased (1%→2.5%), and the toner becomes rough powder and therefore, the mean particle diameter thereof becomes larger (8.0 μm→10.2 μm). Therefore, the toner cannot be sufficiently charged and the image density is lowered (1.45→1.10), and the white background fog is increased (1.0%→3.0%) and the deterioration by duration becomes vehement.

Also, in Conventional Example 2, the consumption mode is at the same interval as in the present embodiment, but the toner consumption amount of the downstream developing device 5 in the consumption mode is the same as the toner consumption amount of the upstream developing device 4 and therefore, generally there is more improved effect than in Conventional Example 1, but the image density and the white background fog tend to be deteriorated as an image. This is because the image density is recognized as being low if it is below 1.3, and the white background fog is somewhat recognized as fog if it is 2% or greater.

In contrast, in the present embodiment, the amount of extraneous amount after the duration does not change and the increase in the mean particle diameter (8.0 μm→8.5 μm) is not remarkable and therefore, the image density and the white background fog are adapted to be within the practical ranges of 1.35 and 1.2%, respectively.

As described above, in the present embodiment, during the other consumption mode than image outputting, the consumption amounts of the upstream developing device 4 and the downstream developing device 5 are changed relative to the consumption amounts during image outputting so that the toner consumption amounts may be reversed, whereby it becomes possible to provide a developing apparatus and an image forming apparatus which suffer little from the deterioration of image.

Embodiment 2

While in Embodiment 1 described above, the toner consumption times (toner discharge times of the upstream developing device 4 and the downstream developing device 5 in the consumption mode are changed to thereby change the consumption amounts, in this embodiment, the toner consumption times are fixed and the toner consumption efficiency is changed to thereby achieve a similar effect.

Figure 8:
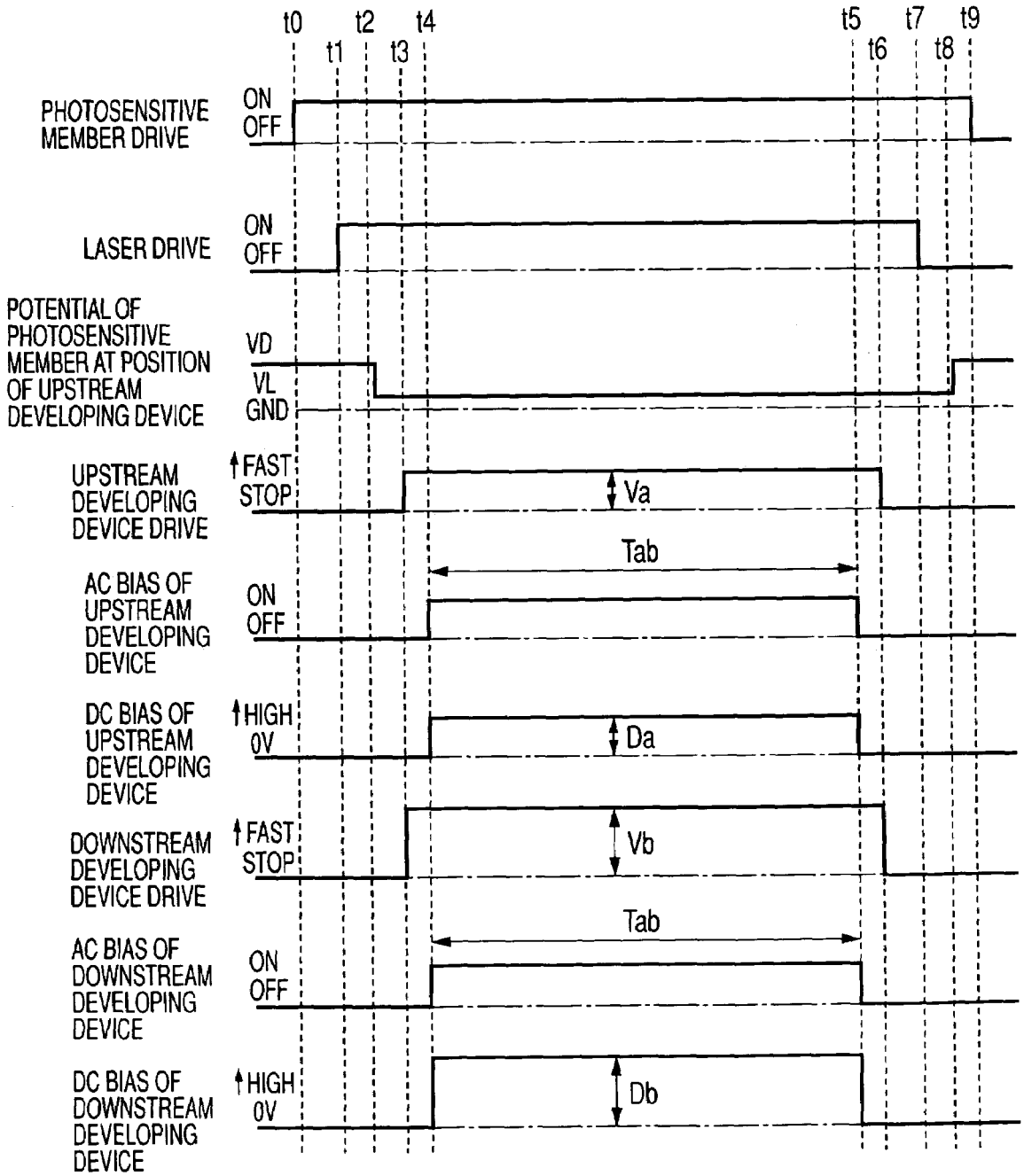
FIG. 8 is a time chart in the consumption mode of Embodiment 2.

FIG. 8 is a time chart illustrating the above-described consumption mode.

First, the photosensitive drum 1 (hereinafter suitably referred to as the "photosensitive member") is driven rotated (time t0, hereinafter simply referred to as "t0"). However, in a case where as shown in FIG. 4, the consumption mode is executed after the achievement of image outputting, and is executed during the post rotation of the photosensitive member 1, the photosensitive member may be driven from the first. At the timing to whereat the driving of the photosensitive member 1 is rendered ON, the driving of the laser is OFF, the potential of the photosensitive member at the position of the upstream developing device 4 is dark portion potential (VD), the driving of the upstream developing device 4 is stopped, the AC bias of the upstream developing device 4 is OFF, the DC bias of the upstream developing device 4 is 0V, the driving of the downstream developing device 5 is stopped, the AC bias of the downstream developing device 5 is OFF, and the DC bias of the downstream developing device 5 is 0V.

Next, the laser is turned on with a predetermined quantity of light (t1), whereupon in accordance with the rotation of the photosensitive member 1, a predetermined time after, the potential of the photosensitive member at the position of the upstream developing device 4 becomes light portion potential VL (t2), and toner development becomes possible. Then, the driving of the upstream developing device 4 and the downstream developing device 5 is effected (t3). At this time, the number of revolutions Va of the developing sleeve 41 (see FIG. 2) of the upstream developing device 4 is made smaller than the number of revolutions Vb of the developing sleeve 51 of the downstream developing device 5. A developing bias is applied to each of the upstream developing device 4 and the downstream developing device 5 (t4). Here, the developing bias is the AC bias and DC bias of the upstream developing device 4, and is the AC bias and DC bias of the downstream developing device 5. When the AC bias and the DC bias are applied, the development of the electrostatic latent image on the surface of the photosensitive member is started. The electrostatic latent image in the light portion of light portion potential VL thereof is developed into a solid image. At this time, the value Da of the DC bias applied to the upstream developing device 4 is set lower than the value Db of the DC bias applied to the downstream developing device 5. As described above, the upper developing device 4 is made slow in the rotation of the developing sleeve 41 and is made low in the value Da of the applied DC bias, relative to the downstream developing device 5, whereby the toner consumption amount per unit time is greater in the downstream developing device 5 than in the upstream developing device 4.

Thereafter, after the lapse of a predetermined time Tab, all of the AC bias and DC bias of the upstream developing device 4 and the downstream developing device 5 are rendered OFF (t5), whereupon the development by the upstream developing device 4 and the downstream developing device 5 is stopped. Also, the driving of the upstream developing device 4 and the downstream developing device 5 is stopped (t6). Thereafter, the laser is turned off (t7), the potential of the photosensitive member is rendered into the state of the dark portion potential VD (t8), and the photosensitive member 1 is stopped (t9). Thereby, the consumption mode is terminated.

Again in the case of the present embodiment, as shown in FIG. 6, the toner consumption amount of the upstream developing device 4 and the toner consumption amount of the downstream developing device 5 can be reversed during image outputting and during the consumption mode. That is, during image outputting, the toner consumption amount Hb of the downstream developing device 5 has been smaller than the toner consumption amount Ha of the upstream developing device 4, whereas during the consumption mode, the toner consumption amount Ub of the downstream developing device 5 can be made greater than the toner consumption amount Ua of the upstream developing device 4.

According to the present embodiment, the time spent to execute the consumption mode can be made shorter than in Embodiment 1 described above. Therefore, the time spent for other than image outputting can be shortened to thereby improve the usability by the user.

Embodiment 3

In this embodiment, unlike Embodiment 1 and Embodiment 2, design is made such that the consumption mode of the upstream developing device 4 and the consumption mode of the downstream developing device 5 are executed at different times without duplicating.

Figure 9:
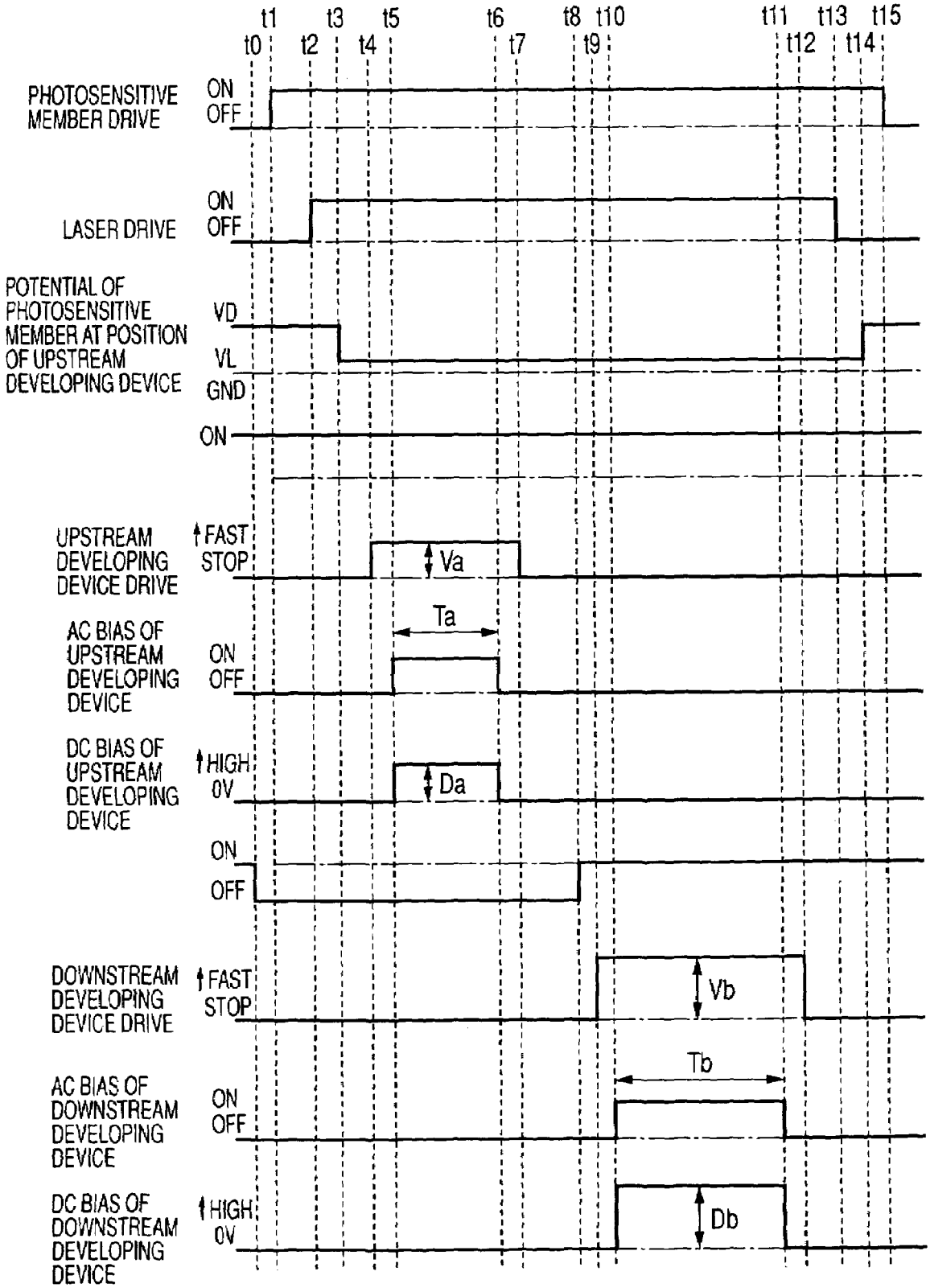
FIG. 9 is a time chart in the consumption mode of Embodiment 3.

FIG. 9 is a time chart illustrating the flow of the consumption mode in the present embodiment. In the time chart shown in FIG. 9, the items of the pressurization (ON and OFF) of the upstream developing device and the pressurization (ON and OFF) of the downstream developing device are added to the above-described Embodiments 1 and 2. In the present embodiment, however, as shown in FIG. 2, the upstream developing device 4 is normally pressurized by the pressure spring 46 (pressurization is ON), and the pressurization of the downstream developing device 5 is adapted to be rendered ON/OFF by the eccentric cam 57. When the pressurization of the downstream developing device 5 is ON, the developing sleeve 51 is adapted to approach the surface of the photosensitive drum 1 (photosensitive member 1) with a predetermined gap therebetween, and when the aforementioned pressurization is OFF, the developing sleeve 51 is adapted to be spaced apart (retracted) from the surface of the photosensitive drum 1.

As shown in FIG. 9, the eccentric cam 57 of the downstream developing device 5 is operated to thereby render the pressurization of the downstream developing device 5 OFF (t0) and retracted the downstream developing device 5 from the photosensitive member 1 so as not to contribute to development.

Next, the photosensitive member 1 is driven (rotated) (t1) and the laser is turned on with a predetermined quantity of light (t2), whereupon with the rotation of the photosensitive member 1, a predetermined time after, the potential of the photosensitive member at the position of the upstream developing device 4 becomes the light portion potential VL, and toner development becomes possible (t3). Subsequently, the developing sleeve 41 of the upstream developing device 4 is rotated (driven) at a number of revolutions Va (t4), and a developing bias is applied to the upstream developing device 4 (t5). Here, the developing bias is the AC bias and DC bias of the upstream developing device 4, and since the photosensitive member 1 is at the light portion potential VL, the surface of the photosensitive member 1 starts to be developed by the upstream developing device 4. The value of the DC bias at this time is defined as Da. Thereafter, after the lapse of a time Ta from t5, the AC bias and DC bias of the upstream developing device 4 are rendered OFF (t6), whereupon the development by the upstream developing device 4 is stopped. Also, the driving of the upstream developing device 4 is stopped (t7).

Subsequently, the pressurization of the downstream developing device 5 is rendered ON (t8). The developing sleeve of the downstream developing device 5 is rotated (driven) at a number of revolutions Ub (t9), and a developing bias is applied to the downstream developing device 5 (t10). The developing bias here is the AC bias and DC bias of the downstream developing device 5, and when the AC bias and the DC bias are applied to the downstream developing device 5, the development by the downstream developing device 5 is started on the photosensitive member 1 because the photosensitive member 1 is at the light portion potential VL. The value of the DC bias is defined as Db. Thereafter, after the lapse of time Tb from t10, the AC bias and DC bias of the downstream developing device 5 are rendered OFF (t11), whereupon the development by the downstream developing device 5 is stopped. The driving of the downstream developing device 5 is stopped (t12). Then, the laser is turned off (t13), and the potential of the downstream developing device is rendered into the state of the dark portion potential VD (t14), and the photosensitive member 1 is stopped (t15). Thereby, the consumption mode is terminated.

In the present embodiment, the consumption modes of the upstream developing device 4 and the downstream developing device 5 are controlled completely independently of each other. That is, the driving and the ON of the AC bias and the ON of the DC bias, of the upstream developing device 4, and the driving and the ON of the AC bias and the ON of the DC bias, of the downstream developing device 5 are effected at different times without duplicating in time.

In a case where at this time, the pressurization force of the downstream developing device 5 is controlled and the downstream developing device 5 is retracted (spaced apart) from the photosensitive member 1, whereby the upstream developing device 4 is effecting development, the downstream developing 5 can be adapted not to contribute to development. Therefore, in the case of the consumption mode of the upstream developing device 4, the toner consumed thereby does not enter the downstream developing device 5, and the consumption becomes efficient. Assuming that the developing sleeve 51 of the downstream developing device 5 is located near the photosensitive member, even if the DC bias and AC bias which are the developing bias are made into any values and even if the driving of the developing sleeve 51 of the downstream developing device 5 is stopped, the magnetic toner on the photosensitive member 1 flies by the magnetic field of a magnet (not shown) in the developing sleeve 51 and is collected onto the developing sleeve 51 of the downstream developing device 5. In order to prevent such an inconvenience, the developing sleeve 51 of the downstream developing device 5 is adapted to be retracted.

Again in the case of the present embodiment, as shown in FIG. 6, the toner consumption amount of the upstream developing device 4 and the downstream developing device 5 can be reversed during image outputting and during the consumption mode. That is, during image outputting, the toner consumption amount Hb of the downstream developing device 5 has been smaller than the toner consumption amount Ha of the upstream developing device 4, whereas during the consumption mode, the toner consumption amount Ub of the downstream developing device 5 can be made greater than the toner consumption amount Ua of the upstream developing device 4.

According to the present embodiment, the time spent to execute the consumption mode can be made shorter than in Embodiment 1 described above. Therefore, the time spent for other than image outputting can be shortened to thereby improve the usability by the user.

Embodiment 4

In this embodiment, design is made such that the accuracy of the consumption mode is more enhanced with the toner consumption amounts of the respective developing sleeves 41 and 51 of the upstream developing device 4 and the downstream developing device 5 in the longitudinal direction (axial direction) thereof also taken into account.

Figure 10:
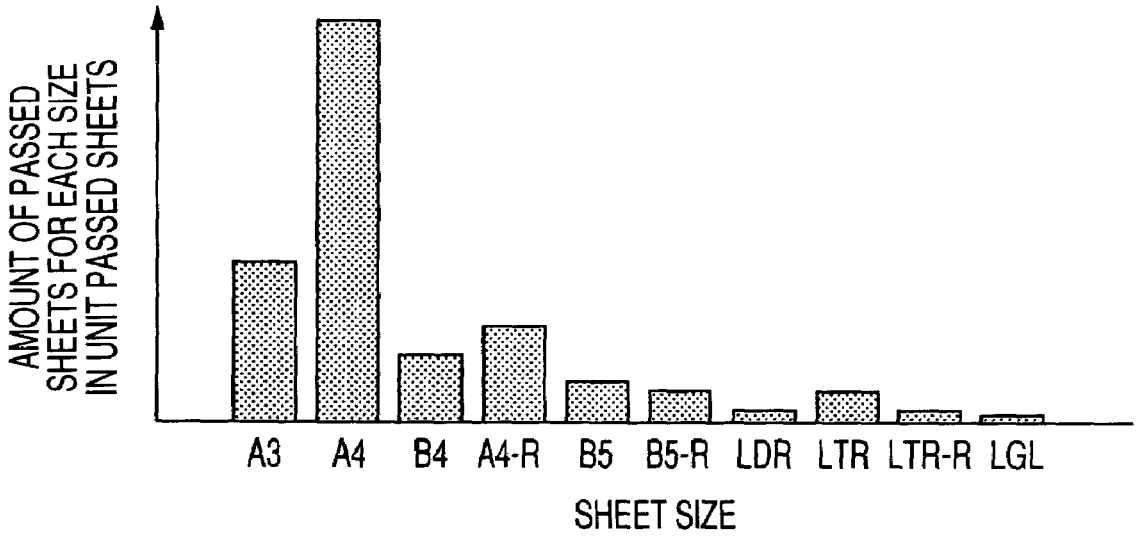
FIG. 10 shows the amount of passed sheets for each size in unit passed sheets.

FIG. 10 shows an example showing the history of sheet passing for each size in unit passed sheets. It shows, for example, the state during the passing of 10,000 sheets, and in this case, the amount of passing of A4 sheets is great, and the amount of passing is greater in the order of A3 and A4R. The longitudinal dimension of each sheet size is known and therefore, from the relation with the history of sheet passing, it becomes possible to make the amount of passed sheets relative to the longitudinal direction of the developing sleeves 41 and 51 into a numerical value.

Figure 11:
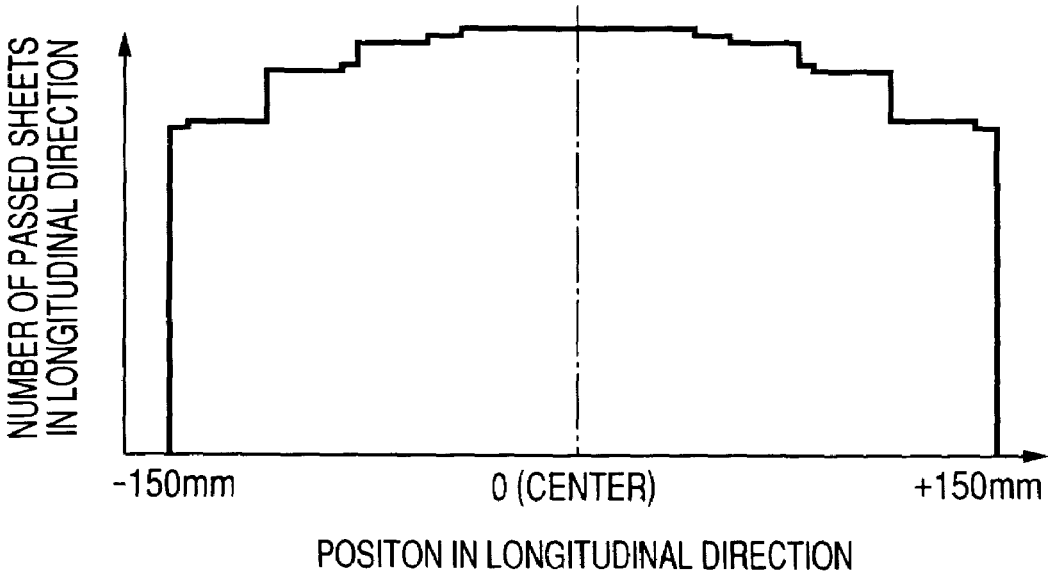
FIG. 11 shows the result of the calculation of the number of passed sheets in a longitudinal direction from the history of sheet passing.

FIG. 11 shows an example in which the number of passed sheets in the longitudinal direction has been calculated from the history of sheet passing. In the case of the present embodiment, the sheet passing to the image forming apparatus uses the center as the reference and therefore, the result of the calculation is bilaterally symmetrical with the centers of the developing sleeves 41 and 51 (the same as the center of the recording material) as the reference. Calculating from the history of sheet passing shown in FIG. 10, there is often obtained a result in which the central portion is high and the end portions are low. This result means that the toner consumption amount in the central portion is high, the toner consumption amount in the end portions is small, and the deterioration of the toner is greater in the end portions than in the central portions.

Figure 12:
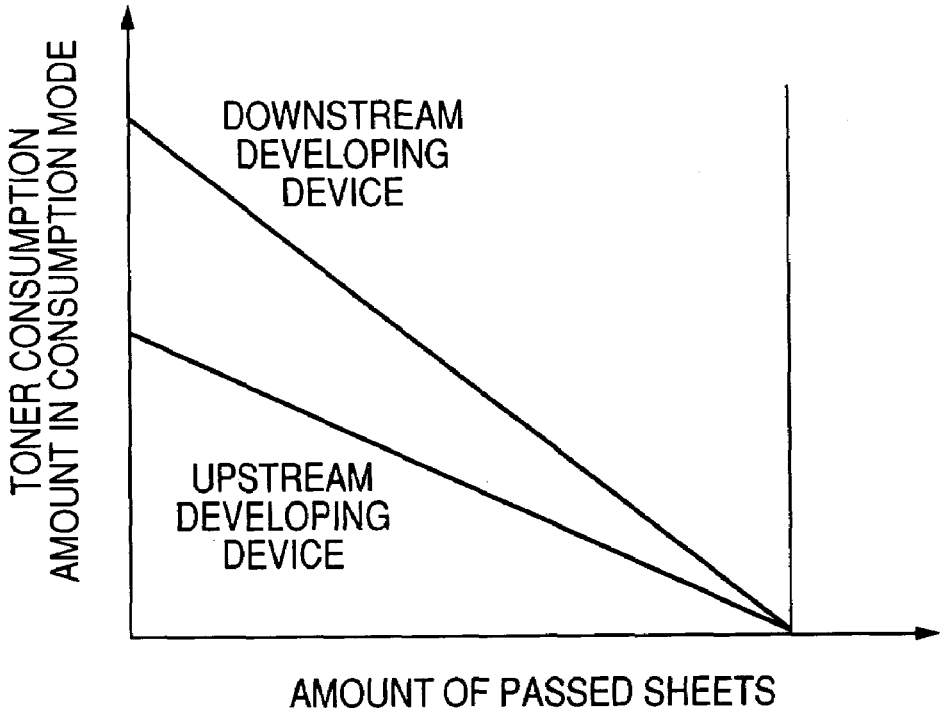
FIG. 12 shows a table for converting the toner consumption amount in the consumption mode to the amount of passed sheets.

FIG. 12 shows a table for converting the toner consumption amount in the consumption mode relative to the amount of passed sheets. This table is such that when the amount of passed sheets is great, the toner consumption amount is decreased, and when the amount of passed sheets is small, the toner consumption amount is increased and the toner consumption amount of the downstream developing device 5 is made smaller than that of the upstream developing device 4.

Figure 13:
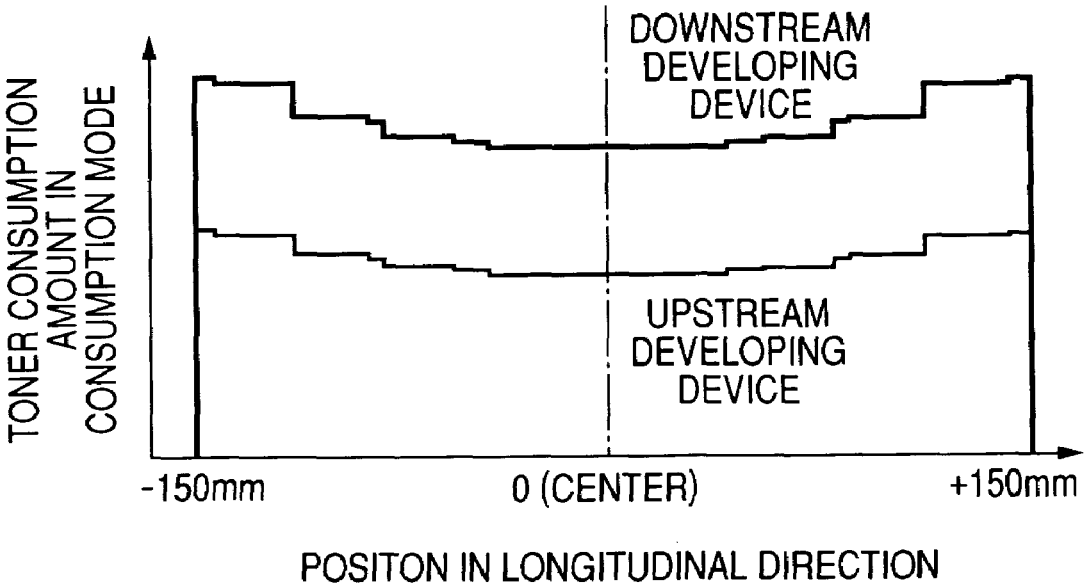
FIG. 13 shows the toner consumption amounts of the upstream developing device and the downstream developing device in the longitudinal direction thereof in the toner consumption mode calculated by the conversion table.

FIG. 13 shows the toner consumption amounts of the upstream developing device 4 and the downstream developing device 5 in the longitudinal direction thereof calculated by the conversion table shown in FIG. 13. The toner consumption amount is greater in the end portions, and is greater in the downstream developing device 5 than in the upstream developing device 4.

Figure 14:
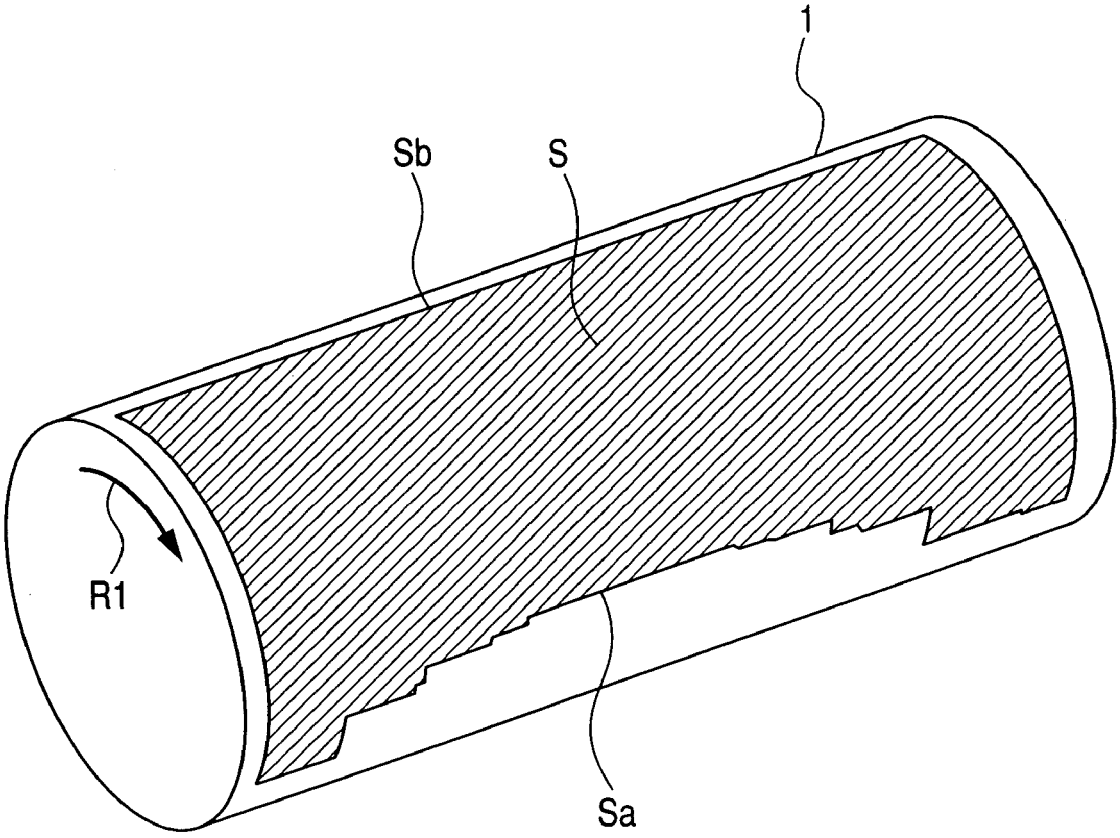
FIG. 14 illustrates the toner consumption amounts of the upstream developing device and the downstream developing device in the longitudinal direction thereof in the toner consumption mode on a photosensitive drum.

FIG. 14 illustrates the toner consumption amounts of the upstream developing device 4 and the downstream developing device 5 in the longitudinal direction thereof in the toner consumption mode. The hatched portion S of the surface of the photosensitive member 1 corresponds to the toner consumption amount. The driving of the laser is effected so that the distribution in the longitudinal direction may be reflected upon the downstream end portion Sa of the hatched portion S with respect to the direction of rotation (the direction of arrow R1) of the photosensitive drum 1, to thereby make the toner consumption amount in the upstream end portion Sb constant. This is because if the distribution in the longitudinal direction is reflected upon the upstream end portion Sb, the influence of a level difference caused by the distribution of the consumption mode in the longitudinal direction during the image outputting after the consumption mode will occur.

As described above, relative to the longitudinal direction of the developing sleeve, the toner consumption amount in the consumption mode is determined with the distribution of the toner consumption by the amount of passed sheets during image outputting taken into account and therefore, it becomes possible to provide an appropriate toner consumption amount without unnecessarily consuming the toner.

While in the present embodiment, the toner consumption amounts of the developing sleeves 41 and 51 in the longitudinal direction thereof are estimated from the history of sheet passing for sheet size, it is likewise effective to accurately calculate the coverage rate in the longitudinal direction by preparing a video counter or the like divided in the longitudinal direction.

While in the above-described embodiments, description has been made of a case where the present invention is applied to a black-and-white image forming apparatus of the electrophotographic type, the present invention is not restricted thereto, but can also be applied to the developing apparatus of each color of a four-color full-color image forming apparatus.

This application claims priority from Japanese Patent Application No. 2004-259958 filed on Sep. 7, 2004, which is hereby incorporated by reference herein.

What is claimed is:

1. An image forming apparatus having:

an image bearing member;

developing means having a first developer carrying member carrying a developer thereon, and a second developer carrying member disposed downstream of said first developer carrying member with respect to a direction of movement of the image bearing member, and for developing one and the same electrostatic latent image on said image bearing member with the developer carried on said developer carrying members; and controlling means for executing a developer consumption mode in which the developer carried on said first and second developer carrying members is shifted to said image bearing member at a time other than an ordinary image formation time, wherein said controlling means controls so that during said developer consumption mode, an amount of developer consumed from said second developer carrying member to said image bearing member is greater than an amount of developer consumed from said first developer carrying member to said image bearing member.

2. An image forming apparatus according to claim 1, wherein said controlling means applies a bias to each of said first developer carrying member and said second developer carrying member during said developer consumption mode to thereby effect the consumption of the developer, and said controlling means makes a bias applying time to said first developer carrying member and a bias applying time to said second developer carrying member, during said developer consumption mode, different from each other.

3. An image forming apparatus according to claim 1, wherein said controlling means applies a bias to each of said first developer carrying member and said second developer carrying member during said developer consumption mode to thereby effect the consumption of the developer, and said controlling means makes a value of the bias applied to said first developer carrying member and a value of the bias applied to said second developer carrying member, during said developer consumption mode different from each other.

4. An image forming apparatus according to claim 1, wherein said controlling means controls so that during said developer consumption mode, a time when a developer consuming operation on said first developer carrying member is performed and a time when a developer consuming operation on said second developer carrying member is performed may not overlap each other.

5. An image forming apparatus according to claim 1, wherein said controlling means can change the developer consumption amounts on said first developer carrying member and said second developer carrying member in a longitudinal direction thereof.

* * * * *

UNITED STATES PATENT AND TRADEMARK OFFICE

CERTIFICATE OF CORRECTION

PATENT NO. : 7,260,345 B2
APPLICATION NO. : 11/211553
DATED : August 21, 2007
INVENTOR(S) : Yuji Kamiya It is certified that error appears in the above-identified patent and that said Letters Patent is hereby corrected as shown below:

COLUMN 1:

Lines 62 through 66,

"This is because although on the upstream side, the toner does not adhere to an electrostatic latent image carried to a developing position, the toner has already adhered to the electrostatic latent image when carried to a developing position on the downstream side of the upstream side" should read --This is because although the toner has not been provided to an electrostatic latent image when carried to a developing position on the upstream side, when carried to a developing position on the downstream side, the toner has already adhered to the electrostatic latent image on the upstream side--.

COLUMN 5:

Line 36, "material. P" should read --material P--.

COLUMN 8:

Line 61, "to" should read --t0--.

COLUMN 9:

Line 7, "after," should read --after--.

COLUMN 11:

Line 4, "to" should read --t0--.

Signed and Sealed this

Twenty-ninth Day of April, 2008

JON W. DUDAS
*Director of the United States Patent and Trademark Office*